US005776010A

United States Patent [19]

Helmstetter et al.

[11] Patent Number: 5,776,010

[45] Date of Patent: Jul. 7, 1998

[54] WEIGHT STRUCTURE ON A GOLF CLUB HEAD

[75] Inventors: Richard C. Helmstetter, Rancho Santa Fe; Thomas R. Hilton, Cardiff By the Sea; Donald A. Bistline, Vista; Victor S. Dennis, Carlsbad, all of Calif.

[73] Assignee: Callaway Golf Company, Carlsbad, Calif.

[21] Appl. No.: 787,154

[22] Filed: Jan. 22, 1997

[51] Int. Cl.[6] ..... A63B 53/04

[52] U.S. Cl. ..... 473/334; 473/349; 473/350; 473/338; 473/335

[58] Field of Search ..... 473/324–350, 473/291, 256

[56] References Cited

U.S. PATENT DOCUMENTS

| | | | |
|---|---|---|---|
| D. 228,355 | 9/1973 | Penna . | |
| D. 234,963 | 4/1975 | Hirata . | |
| D. 247,383 | 2/1978 | Adkins . | |
| D. 303,132 | 8/1989 | Muta . | |
| D. 321,920 | 11/1991 | Parente et al. . | |
| D. 360,445 | 7/1995 | Schmidt et al. . | |
| D. 364,206 | 11/1995 | Schmidt et al. . | |
| 1,453,503 | 5/1923 | Holmes | 473/336 |
| 1,854,548 | 4/1932 | Hunt . | |
| 1,980,408 | 11/1934 | Jansky . | |
| 1,993,928 | 3/1935 | Glover . | |
| 2,332,342 | 10/1943 | Reach | 473/338 |
| 2,846,228 | 8/1958 | Reach . | |
| 3,068,011 | 12/1962 | Sano . | |
| 3,693,978 | 9/1972 | East . | |
| 3,841,641 | 10/1974 | Bennett . | |
| 3,847,399 | 11/1974 | Raymont . | |
| 3,863,932 | 2/1975 | Lezatte . | |
| 3,923,308 | 12/1975 | Mills . | |
| 3,967,826 | 7/1976 | Judice . | |
| 3,989,248 | 11/1976 | Campau . | |
| 4,043,562 | 8/1977 | Shillington . | |
| 4,113,249 | 9/1978 | Berry . | |
| 4,199,144 | 4/1980 | Skelly . | |
| 4,313,607 | 2/1982 | Thompson . | |
| 4,355,808 | 10/1982 | Jernigan et al. . | |
| 4,573,685 | 3/1986 | Young, IV et al. . | |
| 4,632,400 | 12/1986 | Boone . | |
| 4,653,756 | 3/1987 | Sato . | |

(List continued on next page.)

FOREIGN PATENT DOCUMENTS

| | | |
|---|---|---|
| 582366 | 2/1994 | European Pat. Off. . |
| 608128 | 7/1994 | European Pat. Off. . |
| 642812 | 3/1995 | European Pat. Off. . |
| 2680695 | 5/1993 | France . |
| 53-15412 | 5/1978 | Japan . |
| 62-233176 | 10/1987 | Japan . |
| 63-19168 | 1/1988 | Japan . |
| 63-267376 | 11/1988 | Japan . |
| 268078 | 3/1990 | Japan . |
| 37178 | 1/1991 | Japan . |
| 371974 | 5/1932 | United Kingdom . |
| 9320904 | 10/1993 | WIPO . |

OTHER PUBLICATIONS

"Getting in Touch", Golf World, p. 54, Feb. 17, 1996.

"Reflex", *Golf Digest*, Feb. 1978, p. 22.

"Some Of Our Best Friends Are Hookers & Pushers", *Golf World*, Jan. 1974, p.45.

The Ounce That Count , *Golf World*, Jan. 24, 1975, pp. 46 & 47.

"Stroke–Savers", *Golf Digest*, Mar. 1988, pp. 8 & 83.

"FTD Iron By First Flight", *Golf World*, May 23, 1972, p. 10.

*Primary Examiner*—Sebastiano Passaniti

*Attorney, Agent, or Firm*—William W. Haefliger

[57] ABSTRACT

An iron type golf club head which comprises a head body having a ball-striking front face, a rear side, a top, a bottom, a toe, and a heel; a recess formed in the head body proximate the head body rear side and bottom; and an inset positioned in the recess; the head body having a weight $W_1$ and the inset having a weight $W_2$, and wherein $W_2/(W_1+W_2)$ is between about 0.25 and 0.90.

35 Claims, 5 Drawing Sheets

U.S. PATENT DOCUMENTS 4,708,347 11/1987 Kobayashi ..... 473/338
4,715,601 12/1987 Lamanna .
4,740,345 4/1988 Nagasaki et al. .
4,792,139 12/1988 Nagasaki et al. .
4,798,383 1/1989 Nagasaki et al. .
4,811,950 3/1989 Kobayashi .
4,848,747 7/1989 Fujimura et al. .
4,854,581 8/1989 Long .
4,884,812 12/1989 Nagasaki et al. .
4,913,438 4/1990 Kobayashi .
4,928,972 5/1990 Nakanishi et al. .
4,938,470 7/1990 Antonious .
4,957,294 9/1990 Long .
4,964,640 10/1990 Nakanishi et al. .
4,995,609 2/1991 Parente et al. .
5,004,241 4/1991 Antonious .
5,011,151 4/1991 Antonious .
5,026,056 6/1991 McNally et al. .
5,046,733 9/1991 Antonious .
5,050,879 9/1991 Sun et al. .
5,067,711 11/1991 Parente et al. .
5,082,279 1/1992 Hull et al. .
5,118,562 6/1992 Johnson et al. .
5,127,653 7/1992 Nelson .
5,176,384 1/1993 Sata et al. .
5,277,423 1/1994 Artus .
5,282,625 2/1994 Schmidt et al. .
5,290,036 3/1994 Fenton et al. .
5,297,803 3/1994 Solheim .
5,301,946 4/1994 Schmidt et al. .
5,310,186 5/1994 Karsten .
5,354,055 10/1994 MacKeil .
5,366,222 11/1994 Lee .
5,409,229 4/1995 Schmidt et al. .
5,423,535 6/1995 Shaw et al. .
5,423,546 6/1995 Manning et al. .
5,451,058 9/1995 Price et al. .
5,482,279 1/1996 Antonious .
5,518,243 5/1996 Redman .
5,540,436 7/1996 Boone .
5,540,437 7/1996 Bamber .
5,544,885 8/1996 Besnard et al. .
5,558,332 9/1996 Cook .
5,562,551 10/1996 Rife .
5,564,705 10/1996 Kobayashi et al. .

FIG. 4.
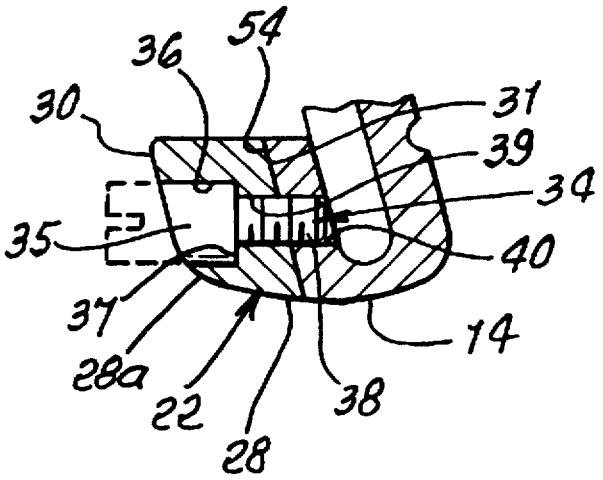
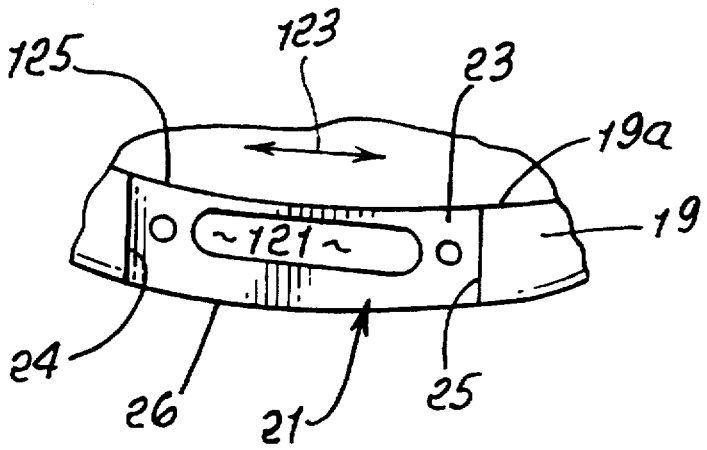
FIG. 5.
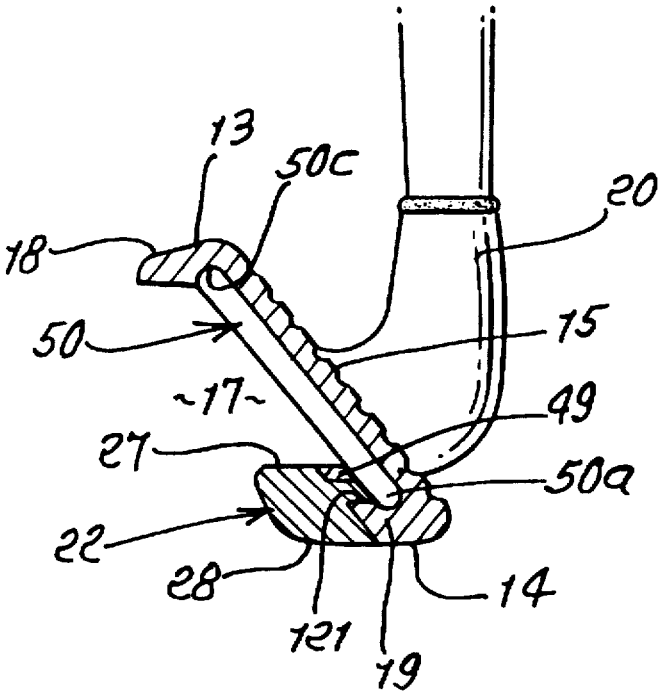
FIG. 6.

WEIGHT STRUCTURE ON A GOLF CLUB HEAD

BACKGROUND OF THE INVENTION

This invention relates generally to a golf club; and more specifically to lowering and moving rearwardly the center of gravity of a ball-striking head of an iron type golf club.

There is a continual desire for improvements in the performance of golf club heads. One means of improvement is associated with lowering and moving rearwardly the center of gravity of such heads. However, no prior iron type golf club head design has disclosed or suggested a way of achieving a golf club head having the weight ratio, volume ratio, and center of gravity positioning of the present invention.

SUMMARY OF THE INVENTION

It is an object of the present invention to provide a golf club head having unique weight distribution and center of gravity positioning.

Basically, such golf club head comprises:

a) a head body having a ball-striking front face, a rear side, a top, a bottom, a toe, and a heel, b) a recess formed in the head body proximate the head body rear side and bottom, and c) an inset positioned in the recess, the head body having a weight $W_1$ and the inset having a weight $W_2$, wherein the ratio $W_2/(W_1+W_2)$ is between about 0.25 and 0.90.

It is another object to locate the inset in a head body rearwardly projecting lowermost flange, thereby spacing the inset rearwardly of a leading edge, defined as the region where the sole and front face meet.

A further object is to further isolate the inset from the leading edge by locating it in a rearward flange separated at least in part from the head front wall, as by a groove between the flange and that front wall. As will be seen, the recess in the flange that receives the inset may intersect that groove, allowing for reception of an abradable surface of the inset. The inset may be removably attached to the flange, as by a fastener or fasteners, or as by adhesive or adhesives, allowing inset removal for abrasion of the abradable surface to adjust the weight of the inset. In a preferred embodiment, both fasteners and adhesives are used. Further, the body may have a main recess or cavity open at the rear of the body, with the groove formed as an undercut recess, a portion of which extends forwardly of the inset-receiving recess.

Yet another object is to provide a head body comprising a material $M_1$, and an inset comprising a material $M_2$, where the density of $M_2$ substantially exceeds the density of $M_1$. In this regard, material $M_1$ may be comprised of titanium or aluminum, or titanium or aluminum alloys; and the material $M_2$ may be comprised of tungsten. In a preferred embodiment, material $M_1$ has a preferred density less than 5 g/ml (grams per milliliter), and material $M_2$ has density greater than 19 g/ml.

An additional object is to provide the inset with a concealable portion of predetermined shape, the concealable portion configured to be selectively abraded to adjust the overall weight of the inset. Preferably, the concealable portion locally protrudes interiorly of the body, and is exposed when the inset is removed from the recess. Such abrasion does not affect the positioning or seating of the inset in the recess.

These and other objects and advantages of the invention, as well as the details of an illustrative embodiment, will be more fully understood from the following specification and drawings, in which:

DRAWING DESCRIPTION

FIG. 4 is an enlarged fragmentary section taken on lines 4—4 of FIG. 2;

FIG. 5 is an enlarged fragmentary section looking forwardly at a recess formed in a bottom flange of the FIGS. 1 and 2 head;

FIG. 6 is a view like FIG. 3, but showing the invention applied to a golf club iron head having a higher loft angle;

DETAILED DESCRIPTION

Figure 1:
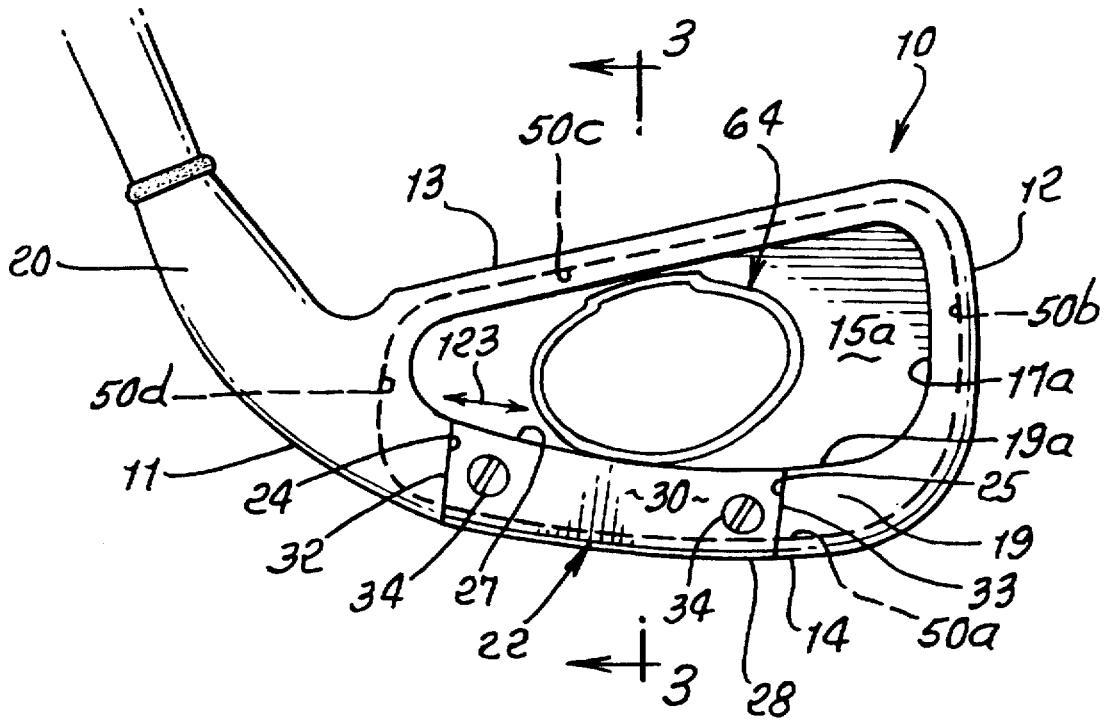
FIG. 1 is a rear view of a golf club iron head incorporating the invention.
Figure 2:
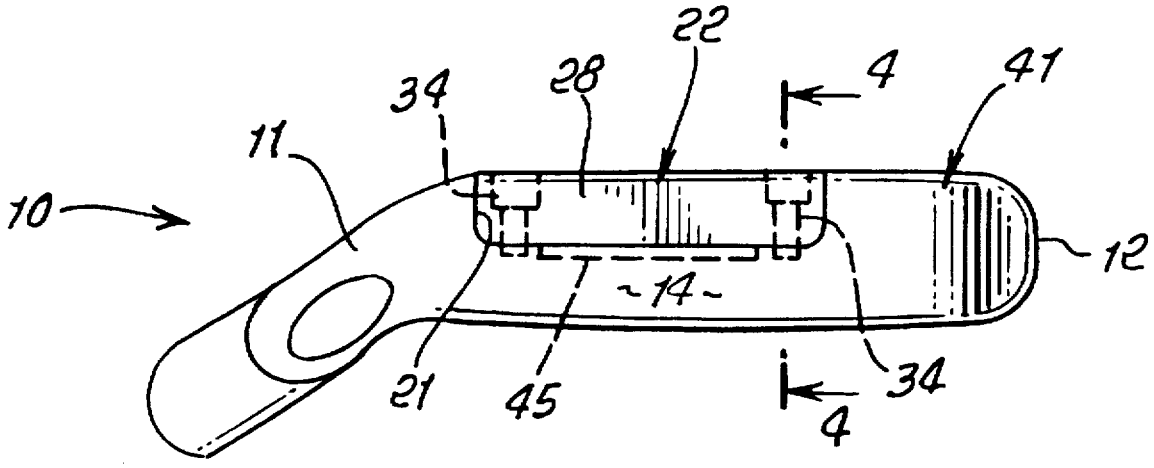
FIG. 2 is a bottom plan view of the FIG. 1 head.
Figure 3:
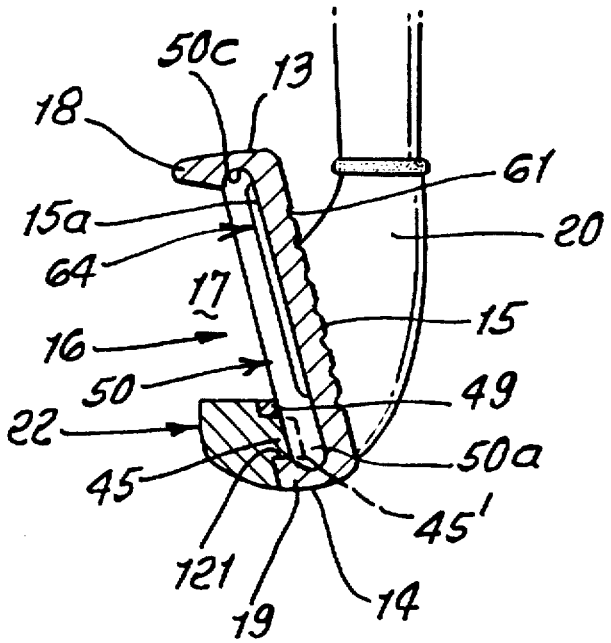
FIG. 3 is a vertical section taken on lines 3—3 of FIG. 1.

FIGS. 1–3 show a golf club iron 10 having a head body 41 defining a heel 11, toe 12, top wall 13, bottom wall or sole 14, and a golf ball striking front face 15. The rear side 16 of the head body may define a main recess or cavity 17, formed between rearwardly projecting upper flange 18 and rearwardly projecting lower flange 19. The hosel is shown at 20. In a preferred embodiment, the head body is comprised of titanium or titanium alloy.

In accordance with the invention, an inset-receiving recess 21 is formed in the head body at a location proximate the head body rear side and bottom, and an inset 22 is positioned in that recess. The inset is characterized as having relatively high density, as compared with the density of the head body; and the size of the inset is such that the weight $W_2$ of the inset constitutes a significant portion of the overall weight $W_2+W_1$ of the golf club head, where $W_1$ is the weight of the head body 41. In this regard, the head body is considered to include the hosel 20, but not the inset 22.

In a preferred embodiment, the ratio $W_2/(W_2+W_1)$ is between about 0.25 and 0.90. In addition, the head body 41 has a volume $V_1$ and the inset 22 has a volume $V_2$, wherein $V_2/(V_1+V_2)$ is between about 0.12 and 0.17.

Figure 7:
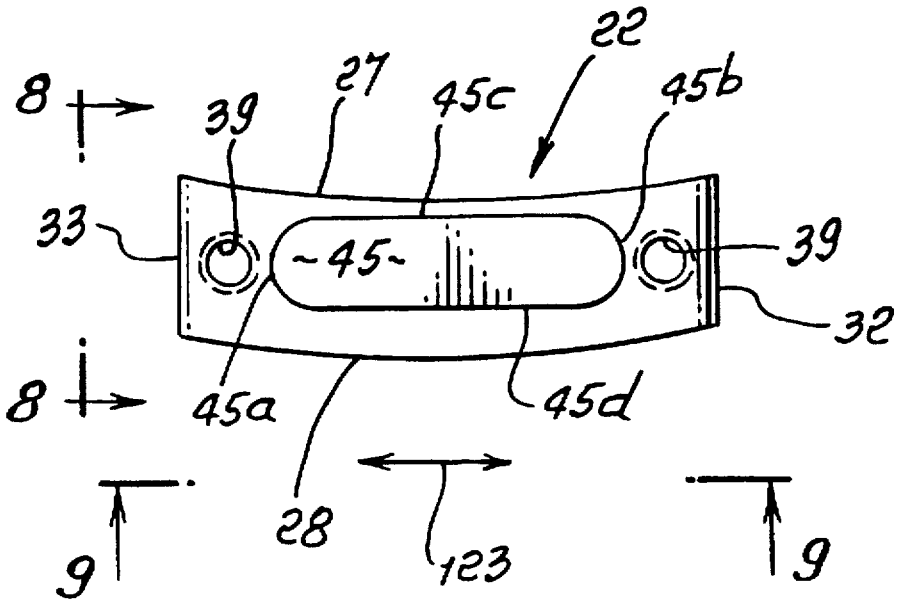
FIG. 7 is an enlarged elevation showing the front side of an inset receivable in the recess shown in FIG. 5.
Figure 8:
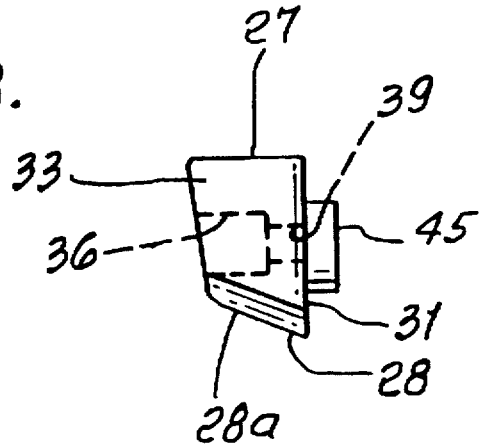
FIG. 8 is an end elevation taken on lines 8—8 of FIG. 7.
Figure 9:
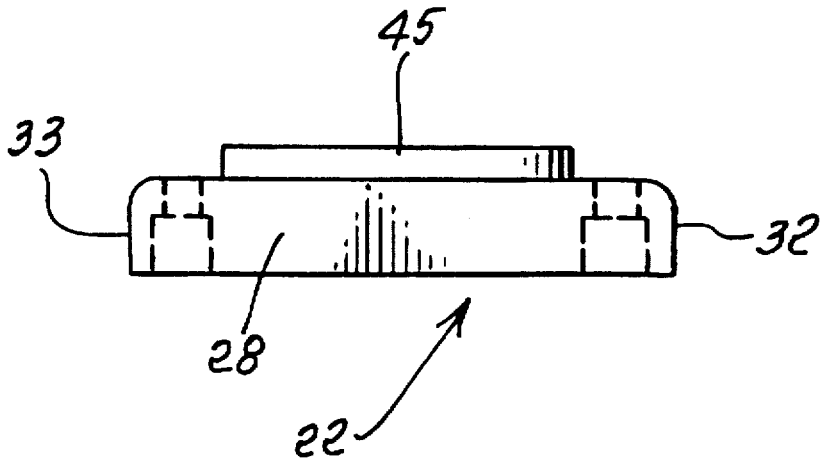
FIG. 9 is a bottom plan view taken on lines 9—9 of FIG. 7.

In a preferred embodiment, as shown in FIG. 5, the inset-receiving recess 21 is formed in the rearwardly projecting flange 19 at a location such that, when the inset 22, as shown in FIG. 7, is received in the recess 21, a substantial center of gravity lowering effect is achieved.

As shown in FIGS. 4 and 5, the recess 21 is elongated in a direction 123 extending between the toe and heel; and it has an innermost forward wall 23 elongated in direction 123, and opposite end walls 24 and 25. The recess 21 intersects the cavity 17 shown in FIG. 3 at locus 125 elongated in direction 123, and it also intersects the head body sole at locus 26 shown in FIG. 5.

Referring back to FIG. 1, when the inset 22 is received in the recess in a preferred embodiment, the upper surface 27 of the inset 22 is contiguous with the upper surface 19*a* of the rearwardly projecting flange 19; and the inset lower surface 28 is contiguous with the bottom surface of the flange 19 at the head sole 14. Note the slightly downwardly arcuate configuration of the recess 21, as seen in FIGS. 1 and 7, and the matching curvature of the inset. As shown in FIGS. 1 and 4, the inset also has a rear surface or shoulder 30, a front surface 31 adjacent or engaging recess interior wall or shoulder 54, and opposite end walls 32 and 33 located adjacent recess walls 24 and 25. Inset lower surface 28 extends rearwardly and upwardly at 28*a* as a smooth continuation of bottom wall 14.

Threaded fasteners 34 removably attach the inset to the head body, as at the locations shown. Note fastener heads 35 received in apertures 36 formed in the inset and engaging interior walls 37; also, note the threaded shanks 38 of the fasteners extending within openings 39 formed in the inset and threaded openings 40 formed in the flange 19 at lower extent of the head body 41. As preferably shown in FIG. 4, when the fastener heads 35 are fully inserted, the fastener heads 35 protrude from the shoulder 30 such that the fastener heads 35 may be abraded down to a smooth finish to produce a flush surface between the fastener heads 35 and the inset 22. Thus, any abrading of, and weight adjustments to, the inset is preferably done prior to affixing the inset via fasteners and/or adhesives, since abrading of the fastener heads makes it more difficult (but not impossible) to remove the inset once the inset is affixed in the recess via the fasteners, and the fastener heads are abraded flush with the inset.

In accordance with an important aspect of the invention, and as referred to, the head body 41 has a weight $W_1$ and the inset has a weight $W_2$. The ratio $W_2/(W_1+W_2)$ lies between 0.25 and 0.90, and preferably between 0.30 and 0.90. In one preferred embodiment, the ratio lies between 0.35 and 0.45. This ratio, and the position of the inset, provides a very low center of gravity location in the club head. In this regard, the head body, or body, comprises material $M_1$, and the inset comprises material $M_2$, wherein the density of $M_2$ substantially exceeds the density of $M_1$. In a preferred embodiment, $M_2$ comprises tungsten, and the head body comprises a substantially less dense material, such as titanium or titanium alloy. The ratio of densities $M_2/(M_2+M_1)$ is between about 0.70 and 0.90, and preferably between 0.75 and 0.85. More preferably, the ratio is about 0.81 when $M_2$ is 19.3 g/ml for tungsten, and $M_1$ is 4.5 g/ml for titanium. It is to be understood that alternative materials can be used for material $M_1$ such as ceramic metals (cermet), metal matrix composites (MMC), and carbon fiber composites, and that alternative materials can be used for material $M_2$ such as depleted uranium. The use of such alternative materials are considered to be within the scope of the present invention.

Figure 10:
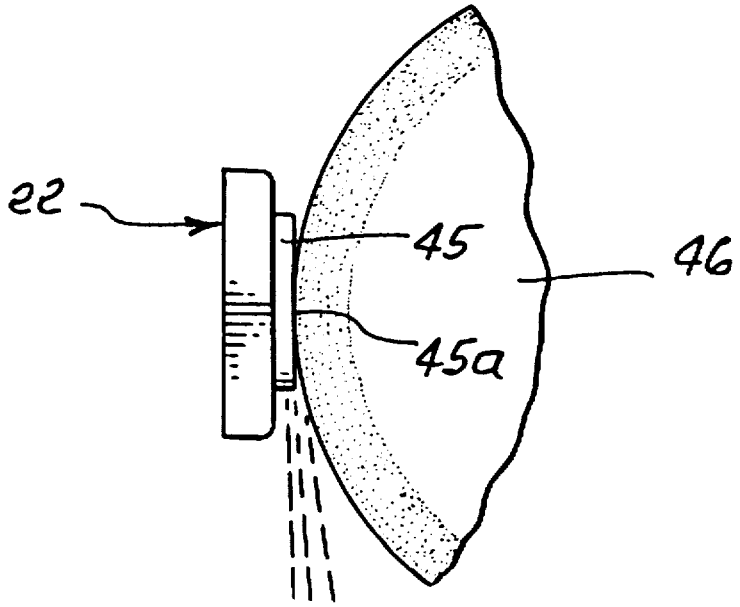
FIG. 10 is a schematic view showing abrading of an internally projecting portion of the inset to adjust inset weight.

In accordance with a further important aspect of the invention, the inset has a concealable portion of predetermined shape, the concealable portion is configured to be selectively abraded (including grinding, machining, or any other alternative means of removing excess material) to adjust the overall weight of the inset. See in this regard FIGS. 7–10 showing a concealable portion defined by a reduced size forward projection 45 integral with the inset and elongated in direction 123. When the inset is removed from the recess, the concealable projection 45 is exposed and can then be abraded, as is illustrated in FIG. 10, by employing a grinding wheel 46. Such controlled abrasion selectively adjusts the inset weight, without changing its fit to the head body. Accordingly, a manufacturer may "fine tune" the inset weight $W_2$ relative to the head body weight $W_1$, to best match the target weight parameters and weight ratios desired in a finished golf club head design. Such "fine tuning" is preferably done prior to permanently affixing the inset in the recess.

In this regard, if a heavier inset is required, as characterized by a projection 45 extending forwardly to a greater extent, it may be substituted for the inset shown. In addition, the concealable projection 45 may be used to assist in the initial positioning of the inset into the recess, and the projection 45 may also be used to reduce some of the shear stresses that are placed upon the fasteners when the finished golf club head is in use.

As shown in FIGS. 3, 5, 6, the inset recess 21 has a reduced size forward extension 121, which projects through interior wall 49 to intersect lower portion 50*a* of a head undercut recess 50. That undercut recess may also loop about the head, as indicated at 50*b*, 50*c*, and 50*d* in FIGS. 1 and 3. Intersection of recess extension 121 with the undercut recess at 50*a* enables protrusion of projection 45 into the undercut recess, as indicated by broken lines 45' in FIG. 3, whereby a larger size, abradable projection 45 may be employed, allowing a wider or larger range of weight adjustment. In addition, by positioning the inset 22 in a further rearward location relative to the ball-striking face 15 of the club head 10, the center of gravity is correspondingly positioned in a deeper, or further rearward location.

Note in FIG. 7 the arcuate opposite ends 45*a* and 45*b* of the projection 45, and its elongated upper and lower sides 45*c* and 45*d*. Such sides and ends match corresponding sides and ends of recess forward extension 121, for a better fit. It is understood that the recess forward extension 121 may be larger than the projection 45.

FIG. 6 is a view like FIG. 3 showing an iron head embodying the invention and having higher loft angularity. The elements of FIG. 6 corresponding to those in FIG. 3 bear the same identifying numerals.

It will further be appreciated, from the above description and drawings, and in summary, that the hosel 20 may be generally tubular, and be comprised of titanium along with the head body 41; and the hosel may be integrally joined with the head body at or proximate the heel 11. The head body may have a generally straight top 13 extending from the heel to the toe; and the ball-striking face may have score lines 61 for preventing hydroplaning of the ball when moisture is on the striking face 15 or on the ball. The striking face is located above the sole 14, which is curved and extends from the heel to the toe. The striking face is also below top 13, and between the toe and heel.

The head rear side is opposite the striking face 15, and the head rear side has cavity 1 7 therein for distributing weight about the periphery of the golf club head. The cavity is inwardly defined by a generally planar rear surface 15*a*, rearward of the striking face. The cavity 17 has a wall, as at 17*a*, generally perpendicular to the rear surface 15*a*. The groove or undercut recess 50 extends about the periphery of the rear surface 15*a*, joining that rear surface with the cavity wall. The cavity extends above the lower flange 19 projecting away from the striking face.

The recess 21, formed in flange 19, is proximate the head body rear side and the sole, the recess being spaced from the striking face. The inset 22 may be securely fixed to the head body within the recess so that a lower surface on the inset forms a continuous curving surface with the sole, the inset being coplanar with the head body rear side. The resultant club head has a low center of gravity which is deeply spaced rearward from the striking face.

As referenced above, the inset has a concealable portion of predetermined shape, adapted to be selectively abraded to adjust the weight of the inset before the inset is affixed to the head body. Such affixing may be achieved by fastener means, as described, and/or by adhesive means, such as an adhesive or epoxy adhesive. Adjustment of the weight of the inset also alters the ratio $W_2/(W_1+W_2)$, accordingly. In addition, a medallion may be securely affixed to the rear surface 15*a*, as indicated at 64 in FIGS. 1 and 3 for decorative purposes, as well as for functional purposes such as vibration absorption or additional weight modifications.

It is understood by those of ordinary skill in the art that the teachings of the present invention may be incorporated into a metal wood type golf club head, and that the term "metal wood" is not limited to metal or to wood materials, but rather, is a commonly used term to describe a type of a golf club head that is different from an iron type golf club head. It is also understood in the art that the lowered, rearwardly positioned center of gravity of the present invention may be moved to a different location by changing the location of the inset in relation to the head body, or by changing the symmetry of the inset itself. For example, in order to move the center of gravity toward the toe, the inset and corresponding recess may be designed further toward the toe region. Moreover, the center of gravity may also be moved toward the toe by abrading more material off of the heel side of the inset and/or projection than the toe side. Similar modifications may be made in a top-to-bottom direction to move the center of gravity closer to the top or bottom of the golf club head.

We claim:

1. A golf club head comprising:

a) a head body having front, top and bottom walls, a rear side, and a heel and a toe, said head body comprising a first material, and b) an inset proximate said bottom wall and said rear side, said inset comprising a second material of a density substantially greater than the density of the first material, said inset having a concealable portion of predetermined shape and adapted for abrading, to adjust the weight of the inset, when the inset is separated from the head body, c) said concealable portion projecting in spaced relation from said bottom wall and from said rear side.

2. The golf club head of claim 1 wherein said concealable portion protrudes internally of said body, and said inset and head body have interengaged shoulders which seat the inset in said body, said concealable abradable portion offset from said interengaged shoulders.

3. The golf club head of claim 1 including fastener means for removably attaching the inset to said head body.

4. The golf club head of claim 1 wherein said head body defines a first recess into which said inset is removably received.

5. The golf club head of claim 4 wherein said first recess is elongated in a direction extending generally between said toe and heel.

6. The golf club head of claim 4 wherein said head body defines a second and relatively smaller recess into which said concealable portion of the inset is received.

7. The golf club head of claim 1 wherein said concealable portion protrudes internally of said body, and said inset and head body have interengaged shoulders which seat the inset in said body, said concealable abradable portion offset from said interengaged shoulders, and including fastener means for removably attaching the inset to said head body, in spaced relation to said concealable portion, said fastener means projecting toward said front wall.

8. A golf club head comprising:

a) a head body having a b all-striking front face, a rear side, a top, a bottom, a toe, and a heel, said rear side forming a cavity, b) a recess formed in the head body proximate the head body rear side and bottom, and below the cavity, and c) an inset consisting essentially of tungsten and positionable in said recess, said head body having a weight $W_1$ and said inset having a weight $W_2$, and wherein the ratio $W_2/(W_1+W_2)$ is between about 0.25 and 0.90, d) said body having a volume $V_1$ and said inset having a volume $V_2$, and where $V_1$ is greater than $V_2$, e) said head body consisting essentially of titanium.

f) said body having a density $M_1$ and said inset having a density $M_2$, and wherein the ratio $M_2/(M_1+M_2)$ is between 0.70 and 0.90.

9. The golf club head of claim 8, wherein said body has a rearwardly projecting top flange, a rearwardly projecting bottom flange, the bottom flange having a bottom surface, said recess intersecting said bottom flange bottom surface and a rearwardmost extent of said bottom flange.

10. The golf club head of claim 9 wherein said inset is secured to said bottom flange, said inset having a bottom surface which is substantially flush with said bottom flange bottom surface, and a rearwardmost surface which is substantially flush with, rearwardmost extent of said bottom flange.

11. The golf club head of claim 10 including fastener means securing said inset to said head body, said fastener means everywhere located above the level of said inset bottom surface.

12. The golf club head of claim 11 wherein said fastener means has a rearwardmost extent located proximate said rearwardmost surface.

13. The golf club head of claim 8 wherein said inset has a block configuration, and with a length less than the head length between the heel and toe.

14. The golf club head of claim 11 wherein the inset has a concealed portion of predetermined shape, and which is configured for abrading to adjust the overall weight of the inset prior to securing of the inset to said head bottom flange.

15. The golf club head of claim 4 wherein the inset has bore means to receive fastener means securing the inset to said head body, said bore means spaced from said inset concealed portion of predetermined shape, which is configured for abrading.

16. The golf club head of claim 8 wherein the ratio $W_2/(W_1+W_2)$ is between about 0.30 and 0.90.

17. The golf club head of claim 8 wherein the ratio $W_2/(W_1+W_2)$ is between about 0.35 and 0.45.

18. The golf club head of claim 8 wherein the ratio $W_2/(W_1+W_2)$ is about 0.45.

19. The golf club head of claim 8 wherein the ratio $V_2/(V_1+V_2)$ is between about 0.10 and 0.20.

20. The golf club head of claim 8 wherein the ratio $V_2/(V_1+V_2)$ is between about 0.12 and 0.17.

21. The golf club head of claim 8 wherein the ratio $V_2/(V_1+V_2)$ is about 0.15.

22. The golf club head of claim 8 wherein said ratio $M_2/(M_1+M_2)$ is between 0.75 and 0.85.

23. The golf club head of claim 8 wherein said ratio $M_2/(M_1+M_2)$ is about 0.80.

24. The golf club head of claim 8 wherein the ratio $W_2/(W_1+W_2)$ is between about 0.45 and 0.90, the ratio $V_2/(V_1+V_2)$ is about 0.15; and the ratio $M_2/(M_1+M_2)$ is about 0.80.

25. The golf club head of claim 19 wherein the ratio $W_2/(W_1+W_2)$ is between about 0.45 and 0.90.

26. The golf club head of claim 19 wherein the ratio $W_2/(W_1+W_2)$ is between about 0.55 and 0.90.

27. The golf club head of claim 19 wherein the ratio $W_2/(W_1+W_2)$ is between about 0.65 and 0.90.

28. A golf club head comprising:

a) a head body having a ball-striking front face, a rear side, a top, a bottom, a toe, and a heel, said rear side forming a cavity, b) a recess formed in the head body proximate the head body rear side and bottom, and below the cavity, and c) an inset consisting essentially of tungsten and positionable in said recess, said head body having a weight $W_1$ and said inset having a weight $W_2$, and wherein the ratio $W_2/(W_1+W_2)$ is between about 0.25 and 0.90, d) said body having a volume $V_1$ and said inset having a volume $V_2$, and where $V_1$ is greater than $V_2$, e) said head body consisting essentially of titanium, f) said rear side having a cavity therein for distributing weight about the periphery of the golf club head, said cavity being defined by a generally planar rear surface rearward of said front face, a generally continuous cavity wall generally perpendicular to said rear surface, and an undercut about the periphery of said rear surface joining said rear surface with the cavity wall.

29. The golf club head of claim 28 wherein said cavity is above a flange projecting away from said front face, said recess formed in said flange proximate said rear side and said bottom, said recess being spaced from said front face.

30. The golf club head of claim 28 wherein the inset has a lowermost surface flush with said bottom and being generally coplanar with said rear side, said inset having a concealable portion of predetermined shape adapted to be selectively abraded to adjust the weight of said inset before said inset is fixed to said body.

31. The golf club head of claim 28 including fastening means for fixing said inset to said body within said recess.

32. The golf club head of claim 28, including a medallion securely fixed to said rear side.

33. A golf club head comprising:

a) a head body having a front wall defining a ball-striking front face, a rear side, a top wall having a top, a bottom wall having a bottom, a toe, and a heel, said rear side forming a cavity, b) a recess formed in the head body proximate the head body rear side and bottom, and below the cavity, and c) an inset consisting essentially of tungsten and positionable in said recess, said head body having a weight $W_1$ and said inset having a weight $W_2$, and wherein the ratio $W_2/(W_1+W_2)$ is between about 0.25 and 0.90, d) said body having a volume $V_1$ and said inset having a volume $V_2$, and where $V_1$ is greater than $V_2$, e) said head body consisting essentially of titanium, f) said front wall also defining a rear face, and corner walls being defined between said top wall and said heel and toe, g) said body defining a forwardly extending main recess located rearwardly of said front wall, h) said body also defining an undercut recess located directly rearwardly of said front wall to intersect said main recess and extending outwardly from said main recess toward at least one of said top wall and bottom walls, and also toward at least one of said corner walls, proximate said rear face, i) the thickness of said one of said top and bottom walls measured in a plane generally parallel to said front wall front face and proximate said rear face being less than the thickness of said one of said top and bottom walls measured in a plane generally parallel to said front face and distal said rear face.

34. A golf club head comprising:

a) a head body having a front wall defining a ball-striking front face, a rear side, a top wall having a top, a bottom wall having a bottom, a toe, and a heel, said rear side forming a cavity, b) a recess formed in the head body proximate the head body rear side and bottom, and below the cavity, and c) an inset consisting essentially of tungsten and positionable in said recess, said head body having a weight $W_1$ and said inset having a weight $W_2$, and wherein the ratio $W_2/(W_1+W_2)$ is between about 0.25 and 0.90, d) said body having a volume $V_1$ and said inset having a volume $V_2$, and where $V_1$ is greater than $V_2$, e) said head body consisting essentially of titanium, f) said front wall also defining a rear face, g) said body defining a forwardly extending main recess located rearwardly of said front wall, h) said body also defining an undercut recess located rearwardly of said front wall rear face and extending outwardly from said main recess and toward said top wall, proximate said rear face, i) the thickness of said top wall measured in a plane generally parallel to said front wall front face and proximate said rear face being less than the thickness of said top wall measured in a plane generally parallel to said front face and distal said rear face.

35. A golf club head comprising:

a) a head body having a front wall defining a ball-striking front face, a rear side, a top wall having a top, a bottom wall having a bottom, a toe, and a heel, said rear side forming a cavity, b) a recess formed in the head body proximate the head body rear side and bottom, and below the cavity, and c) an inset consisting essentially of tungsten and positionable in said recess, said head body having a weight $W_1$ and said inset having a weight $W_2$, and wherein the ratio $W_2/(W_1+W_2)$ is between about 0.25 and 0.90, d) said body having a volume $V_1$ and said inset having a volume $V_2$, and where $V_1$ is greater than $V_2$, e) said head body consisting essentially of titanium, f) said front wall also defining a rear face, g) said body defining a forwardly extending main recess located rearwardly of said front wall, h) and said body having at least one projection extending rearwardly from said front wall and outwardly of said main recess, said projection being rearwardly elongated, i) said body defining a first auxiliary recess located rearwardly of said front face and forwardly of the main extent of said projection, said auxiliary recess extending into proximity with outer surface extent of the head, j) the thickness of said projection measured in a plane generally parallel to said front wall front face and proximate said rear face being less than the thickness of said projection measured in a plane generally parallel to said front face and distal said rear face.

* * * * *